United States Patent [19]

Wilkes

[11] Patent Number: 4,568,617

[45] Date of Patent: Feb. 4, 1986

[54] THIN BANDS AND METHOD AND APPARATUS FOR PRODUCTION THEREOF

[76] Inventor: Donald F. Wilkes, 2816 Charleston, NE., Alburquerque, N. Mex. 87110

[21] Appl. No.: 521,397

[22] Filed: Aug. 8, 1983

[51] Int. Cl.[4] ..... B21H 1/06

[52] U.S. Cl. ..... 428/595

[58] Field of Search ..... 428/577, 595, 586; 72/110; 148/405

[56] References Cited

U.S. PATENT DOCUMENTS

| | | | |
|---|---|---|---|
| 3,314,143 | 4/1967 | McDonald et al. | 72/110 |
| 3,434,322 | 3/1969 | Cowles et al. | 72/110 |
| 3,507,135 | 4/1970 | Polakowski | 72/110 |
| 3,824,820 | 7/1974 | Jeuken et al. | 72/110 |
| 4,173,134 | 11/1979 | Huuskonen et al. | 72/106 |
| 4,176,538 | 12/1979 | Kymmell et al. | 72/110 |

FOREIGN PATENT DOCUMENTS

| | | | |
|---|---|---|---|
| 287893 | 12/1970 | U.S.S.R. | 72/110 |

*Primary Examiner*—L. Dewayne Rutledge
*Assistant Examiner*—John J. Zimmerman
*Attorney, Agent, or Firm*—Burns, Doane, Swecker & Mathis

[57] ABSTRACT

A rolling mill for making endless bands, preferably by cold working precipitation hardenable stainless steel, includes a stationary central work roller and a pair of moveable work rollers, each carried by a corresponding carriage. The movable work rollers are backed by intermediate and drive rollers so as to be stiff in response to bending forces. The drive rollers provide rotary motion to all rollers. By elastically distorting a preform and then rolling it in the peripheral direction, the band is cold worked to a desired thickness. The preform may be obtained by parting an annular ring from tubular stock. Subsequent precipitation hardening of the cold worked band produces a stainless steel band having enhanced strength and endurance, and which is free of welds and similar discontinuities while exhibiting stress relieved edges rather than stress concentrated edges.

3 Claims, 8 Drawing Figures

Fig. 4
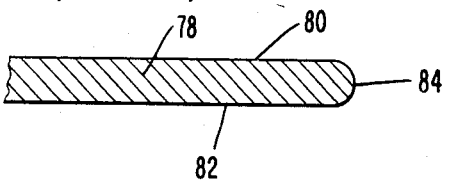
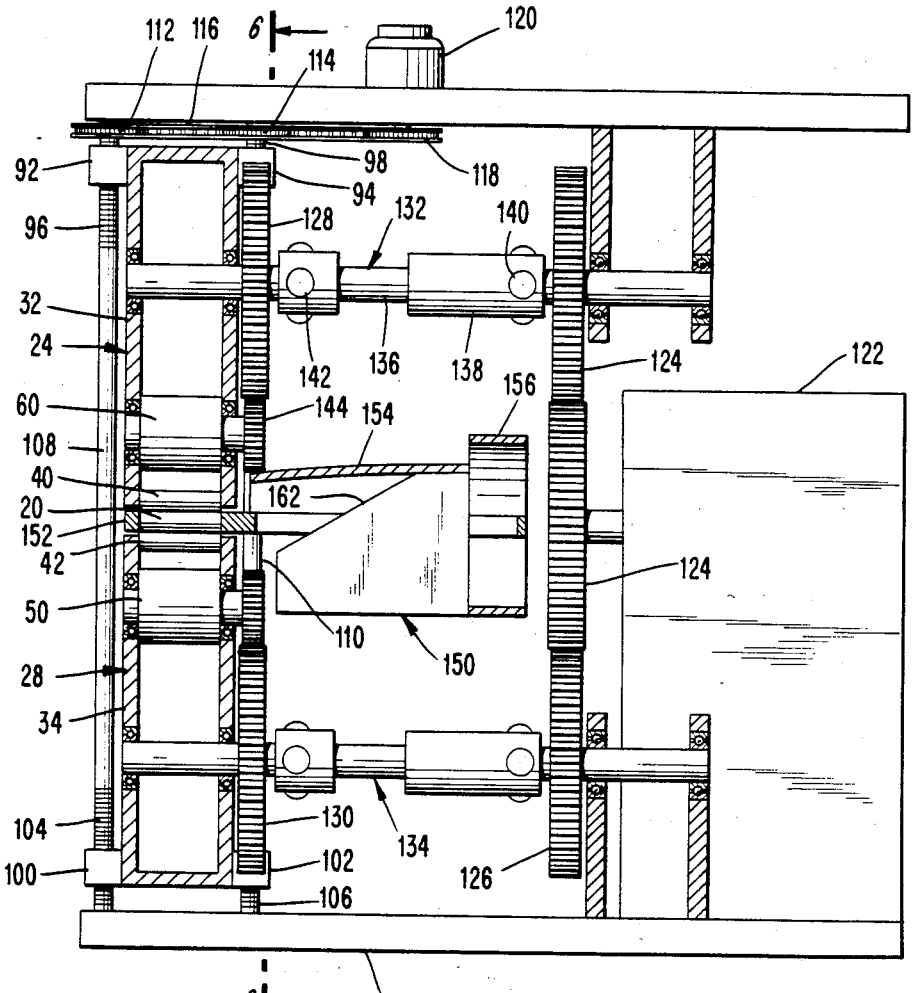
Fig. 5

THIN BANDS AND METHOD AND APPARATUS FOR PRODUCTION THEREOF

BACKGROUND OF THE INVENTION

The present invention relates generally to thin endless bands as well as a method and apparatus for their production. More particularly, the present invention concerns cold rolled endless metal bands, the method of producing those endless metal bands, and apparatus for producing those metal bands.

As used herein, a thin sheet refers to an elastic sheet having sufficient thickness to be resilient when bending stresses are applied, having uniform thickness which does not vary more than 10% above or below the average thickness, having a length along the neutral axis of bending which length is at least twenty times greater than the average thickness and having a width normal to the plane of the neutral axis which is at least greater than the thickness. The actual width of the sheet is irrelevant and need not be uniform. Generally speaking, the average thickness of the sheets must exceed 0.0001–0.0003 inches. While sheets with smaller thicknesses of common sheet materials exhibit raw tensile strength, those sheets cease to exhibit useful structural properties such as bending resilience. And, the average thickness of thin sheets is typically less than 0.10 inches since thicker plates exhibit bending stiffness which is too large.

A ribbon as used herein is a special case of the thin sheet. A ribbon is a thin sheet with a uniform width of at least twenty times the sheet thickness and has parallel side edges. Typically, a ribbon also has smooth surfaces, uniform surface finish, and uniform edge structure.

As used herein, an endless band will be considered to be a ribbon having no ends and forming a closed loop. In the past, a great many different processes have been proposed and employed for making thin sheets and ribbons from continuous materials. However, no process or apparatus has been found which can make an endless metal band without starting from a ribbon. Moreover, few, if any, of the processes for making thin sheets and ribbons have proven to be practical in terms of making highly uniform thin metal sheets and ribbons from materials having high moduli of elasticity, such as spring metals.

Extremely high pressures are required to extrude hot or liquid metals into thin sheets with thicknesses of one hundred-thousandths of an inch (0.100) or less. Moreover, currently available die materials have extremely short useful lives when hot or liquid metals are extruded therethrough. Accordingly, extrusion processes using presently available die materials have proven to be impractical.

The principal process permitting fabrication of thin sheets and ribbons is rolling which may be done with either hot or cold material. In the rolling process, the material passes through the nip of two hard, smooth rollers and is elongated by the reduction in thickness. Since the rollers can be given highly uniform surface finishes, thin sheets and ribbons with reasonably uniform properties can be made.

To date, there are five different types of rolling mill arrangements used in producing metal sheets: two-high mills, three-high mills, four-high mills, cluster mills, and Sendzimir mills. In the two-high, three-high, and four-high mill arrangements, all rollers are arranged with parallel coplanar axes. The cluster mill, on the other hand, has a pair of work rolls with parallel coplanar axes but each work roll is backed by a pair of larger backing rolls having parallel axes which lie in a plane perpendicular to the plane containing axes of the work rolls.

Turning now to the Sendzimir mill, each of a pair of work rolls having parallel coplanar axes is backed by a pair of larger first intermediate rolls. These first intermediate rolls are in turn backed by three drive rolls which themselves are supported by four back-up rolls. Generally speaking, the Sendzimir mill has proven to be superior for fabrication of thin sheets and ribbons since adequate rolling pressures can be maintained without significant bending of the work roller.

To make a band, the past practice has involved forming a ribbon and then fabricating the endless band from the ribbon. Ends of the ribbon were connected by welding, brazing, and similar methods. Moreover, the mating ends of the ribbon were butt welded or attached with a diagonal scarf joint. Endless metal bands fabricated in this foregoing fashion exhibit poor fatigue strength when subjected to repetitive cyclic bending forces. In this connection, it can be seen that the weld, whether it be at a butt joint or a scarf joint, creates a structurally dissimilar area where stress concentrations occur during each bending cycle.

Another problem with known metal bands is their propensity to have zipper-like crack failures which extend perpendicularly to the parallel edges of the band. These cracks typically form when the band is subjected to repetitive cyclic bending.

Endless metal bands which are free from the structural weaknesses caused by the presence of welds and the tendency to propagate cracks normal to the parallel edges have potentially wide-ranging uses. For example, such endless metal bands may be useful in speed-changing devices, as replacements for conventional drive belts, and other power transmitting flexible devices. Accordingly, it will be seen that the need exists for endless metal bands having properties of the type described as well as for a method and apparatus for producing those bands.

SUMMARY OF THE INVENTION

The present invention relates to an endless metal band having a uniform radial thickness, a uniform axial width, being entirely free of welds and having edges which are curved in an axial plane taken transversely through the band. In addition, the band preferably has significant cold rolling thickness reduction in order to enhance endurance, strength, and heat treatability. The band is fashioned from materials such as precipitation hardenable stainless steels like 17-7 PH, 15-5 PH, Carpenter 455 and other high strength stainless steel alloys.

To produce these endless bands, the present invention contemplates starting with a generally cylindrical blank having a predetermined thickness and a uniform axial width. The blank is then placed between a central work roller and a carriage. The carriage contains a work roll in opposition to the central work roller, a pair of intermediate rolls which engage and laterally support the work roll, and a plurality of driving rolls which engage and support the intermediate rolls. While the driving rolls are driven, the carriage is pressed into engagement with the central work roll thereby driving the cylindrical preform through the nip between the central work roll and the carriage work roll so that the preform rotates while being elongated by the cold rolling taking place between the central roller and the work roller. This rolling process continues until the cylindrical preform has its wall thickness reduced to the predetermined final thickness, about 50% of the initial predetermined thickness. When the final thickness has been reached, the carriage is withdrawn from the central work roller and the finished band is ejected from the apparatus.

When it is desired to produce the cold-worked endless metal band in the shortest period of time, it is also possible to provide a second carriage which is movable, diametrically opposed to the first carriage and which also engages the central work roller. Accordingly, the band will be cold-worked between the first carriage and the central work roller as well as between the central work roller and the second carriage during each revolution of the band.

The work roll of each carriage has a first diameter and is backed by a pair of intermediate rolls having a diameter approximately twice that of the work roll. Each of the intermediate rolls is in rolling contact with two of three drive rolls which are driven by a drive means. Each drive roll has a diameter which exceeds the diameter of the intermediate rolls. With such an arrangement of rolls, the work roll is given a very high degree of stiffness against bending by virtue of contact between the work roll and the intermediate rolls and contact between the intermediate rolls and the drive rolls. Moreover, due to a drive means, the drive rolls impart rotational force (torque) to the intermediate rolls which turn impart rotary force (torque) to the work roll.

By mounting the first and second carriages in opposition to one another and in alignment with the central work roll, the central work roll is subjected to balanced forces on each side thereof.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein:

FIG. 4 is a partial cross-sectional view taken through a band fabricated in accordance with the present invention;

FIG. 5 is a partial cross-sectional view through an apparatus suitable for making endless metal bands;

DESCRIPTION OF THE PREFERRED EMBODIMENT

Figure 1:
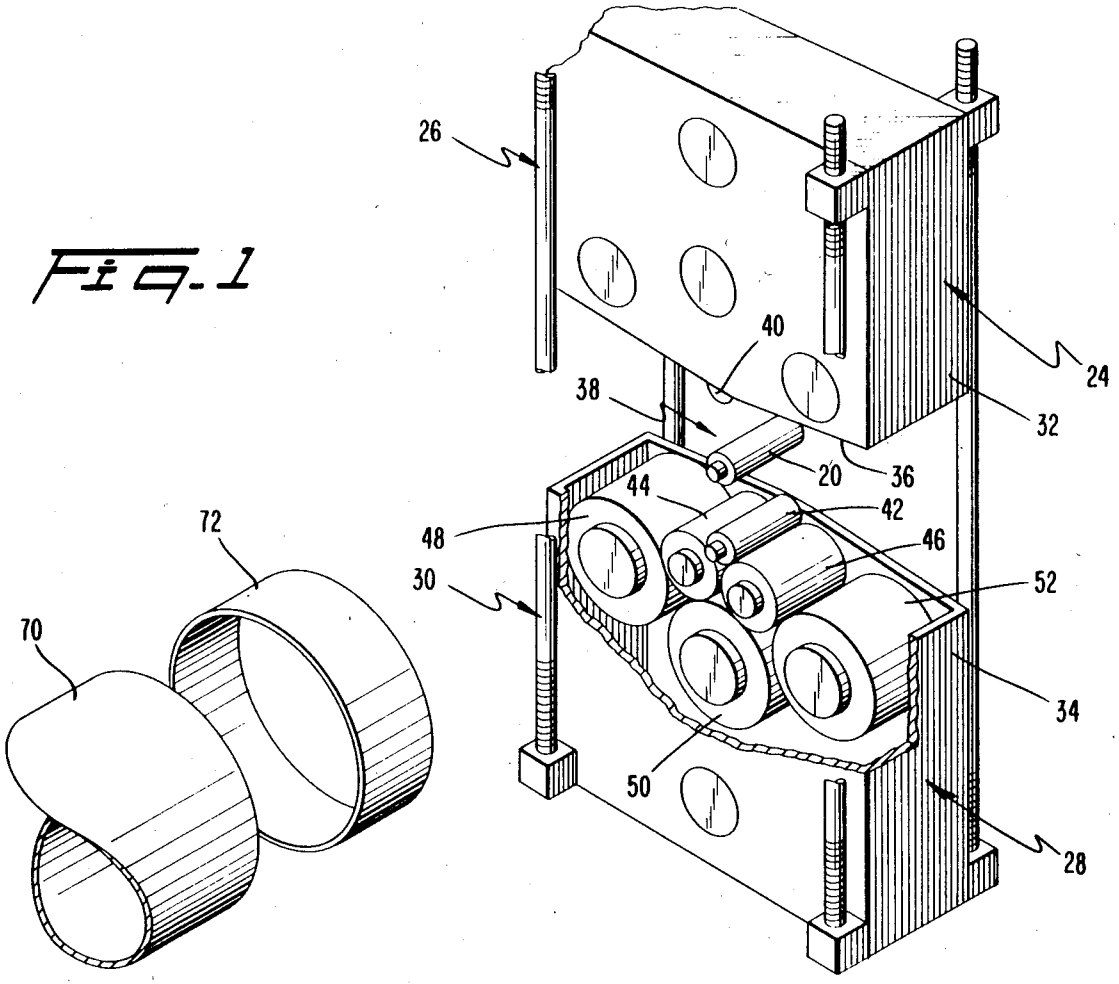
FIG. 1 is a pictorial view of the apparatus of the present invention at the beginning of the method of making an endless metal band.

Sheets of thin materials exhibit some extraordinary properties. For example, a thin sheet cannot be bent so that two or more bends intersect obliquely at a point unless a sharp permanent bend is made. Thus, thin sheets cannot permit elastic curvatures to occur unless those curvatures take place about straight line axes which are non-intersecting within the contiguous boundaries of the original sheet. The presence of discontinuities, re-entrant features, and holes often permit interesting effects and, under proper circumstances, do permit axes of bends to intersect.

Another interesting characteristic of thin sheets concerns the effect of lightly embossed marks in the material. When the thin sheet is bent even to a modest degree about an axis which intersects the embossed feature obliquely, the embossed feature is obliterated.

Yet another unique feature of thin sheets concerns the significant increase in stiffness which can be obtained by either bending the sheet or coiling the sheet into a tube. This result is attributable to the significant increase in buckling resistance which is obtained when the thin sheet is curved.

Rarely are thin sheets perfectly flat. This characteristic is the result of minor imperfections during the manufacturing process and due simply to the weight of the thin sheet makes that sheet vulnerable to buckling at levels of compressive loading that are considerably lower than would be predicted using classical buckling criteria such as Euler's buckling criteria and critical buckling criteria. The significantly increased vulnerability to compressive buckling is due in part to the fact that for thin cross-sections even very small perturbations can trigger buckling.

Even though thin sheets have essentially no compressive strength, even a small amount of bending leaves those thin sheets very strong in buckling. Actually, the increased resistance to buckling can be many orders of magnitude. The increase in buckling resistance is caused by at least two effects: (a) the resultant stiffening and (b) the improvement in the original sheet properties which results from the bending.

When thin sheets are manufactured by commercially available processes, a number of interesting characteristics have been observed. For example, when a thin sheet is cold-rolled to the maximum extent, it frequently exhibits a tensile strength that is twenty to thirty percent higher than thin sheets which are only minimally cold-rolled and up to fifty percent greater than thick cold-rolled sheets of the same metal. In addition, thin cold-rolled materials can be subsequently heat-treated while coiled in large diameter rolls. That coiling bends the material producing further uniformity in the material itself while tightly constraining the material during the heat treatment.

The most favorable heat treatment for thin sheet materials appears to be precipitation hardening. Moreover, for the known materials which can be cold-rolled and which can also be precipitation hardened, another unique characteristic exists. The endurance life of the work hardened and precipitation hardened product is substantially improved in comparison to the endurance life of the cold-rolled material prior to precipitation hardening. This effect is fortuitous and is contrary to intuition and experience since the endurance level is ordinarily reduced with work hardening such as cold-rolling. The alloys with which this application is primarily concerned are precipitation hardenable stainless steels such as 17-7 PH, 15-5 PH, and Carpenter 455 as well as others of this type.

In the past bands have been formed by shearing or cutting operations which characteristically result in a cusp extending above one of the surfaces. Since the stiffness exhibited by a thin sheet against bending varies as the cube of the sheet thickness, the effect of the cusp is very deleterious. The cusp not only increases the local bending stiffness but also significantly increases the overall stress level for a given bending deflection since the cusp has significant size in terms of the thickness of the sheet. Even if a perfectly square corner could be obtained, that square corner would act as a stress concentration. Such localized increases in bending stiffness and localized stress concentration trigger crack formations and fracture of the thin sheet ribbon or band at those localized areas. The cracks or fractures are intolerable where the band will be subjected to repeated cyclic bending stresses since the cracks will propagate and eventually cause failure of the entire band.

It has been found, however, that cold-rolling of thin materials produces a highly desirable edge condition all by itself due to the friction locking between surfaces of the sheet and surfaces of the forming rollers during the process. During this process, the unsupported edge extending between the rollers is free to protrude so that the edge is effectively rounded. This rounding not only eliminates the stiffness variations from cusps but also reduces the stress concentration of sharp corners.

Turning now to the apparatus for making endless metal bands in accordance with the present invention (FIG. 1), a central work roller 20 is provided which has a highly finished cylindrical surface. Preferably, the central work roller 20 is fabricated from tungsten carbide or hardened tool steel. The central work roller 20 can be made by the centerless grinding technique with the best surface finish available. Ideally, an appropriate surface finish for the roller 20 is round within 0.5 millionths of an inch and has a one micro-inch double A surface finish.

The central work roller 20 has an axial length which slightly exceeds the width of the endless metal band to be fabricated. In this manner the bending movements exerted on the roller 20 are minimized since the metal being processed is distributed over almost the entire length of the roller. Moreover, the central work roller 20 has a predetermined diameter which is approximately one-half the axial length of the roller 20. By making a roller with a ratio of roller length to roller diameter of approximately two to one, a roller which is very stiff in response to laterally applied bending forces is achieved. Since the cold-rolling process effectively exerts bending forces on the work rolls, it is particularly important that the work roller have the largest bending stiffness possible.

The central work roller 20 is mounted so as to be restrained against movement perpendicular to its axis 22 and in the plane separating first and second carriage assemblies 24, 28. In addition, the central work roller 20 is rotatably mounted so that it can be driven as the material being cold-worked is processed.

Disposed above the central work roller 20 is the first or upper carriage means 24. The upper carriage means 24 is attached to a suitable conventional controlling device 26 which is operable to move the upper carriage 24 with respect to the central roller 20. Preferably, the means 26 will be operable to move the carriage 24 to a remote position so that band preforms may be positioned in the apparatus and also is operable to move the upper carriage 24 into operative engagement with the preform being pinched in the nip between a work roller of the upper carriage 24 and the central work roller 20.

The second or lower carriage means 28 is in all material respects identical to the upper carriage 24. This identity of structure contributes to symmetrical application of cold working pressure on material being cold-worked. The lower carriage 28 is also provided with means 30 for moving the lower carriage means 28 with respect to the central work roll 20. If desired, the carriage shroud 32 of the upper carriage 24 and the carriage shroud 34 of the lower carriage 28 may be flared away from the associated work roller, as shown at 36, in order to provide minimal obstruction in the work zone 38 defined between the upper carriage 24 and the lower carriage 28.

Each carriage 24, 28 contains and retains a set of rollers and holds those rollers in operative relationship with respect to one another and with respect to the central work roller. More particularly, the upper carriage 24 has a first or upper work roller 40 whereas the lower carriage 28 has a second or lower work roller 42. The axes of the central work roll 20, the upper work roll 40 and the lower work roll 42 are parallel to one another and lie in the same plane. Accordingly, when the upper carriage means 24 and lower carriage means 28 are brought into operative position with respect to the central work roll 20 the work preform is pinched in two nips defined between the work rolls 20, 40, and 42. Preferably, the work rolls 40, 42 are identical in size, shape, material and surface finish to the central work roll 20. This identity of size, shape, material and surface finish between the work rolls 40,42 and the central work roll 20 contributes to a symmetrical cold working of the work preform as it passes through the two nips.

In order to provide lateral support against bending pressures exerted during the rolling operation on the work roll 42, a pair of intermediate rollers 44, 46 are provided in the lower carriage 28. Corresponding intermediate rollers are provided in the upper carriage 24. Each intermediate roller 44, 46 is rotatably mounted in the lower carriage 28 and has rolling contact with the cylindrical surface of the lower work roll 42.

The rotational axes of the intermediate rolls 44, 46 are parallel to one another and parallel to the axes of the lower work roll 42. However, the axes of the intermediate rolls 44, 46 lie in a plane which is perpendicular to the plane containing the axes of the work rolls 20, 40, 42. Each of the intermediate rolls 44, 46 has a cylindrical surface which is highly finished and is fabricated by centerless grinding. Preferably, the diameter of each of the intermediate rolls 44, 46 is approximately twice the diameter of the corresponding work roll 42. In addition, the axial length of the cylindrical surfaces of the intermediate rolls 44, 46 is preferably selected to be essentially coextensive with the length of the cylindrical surface of the work roll 42. With this arrangement, the intermediate rolls 44, 46 provide a substantially stiffened resistance to any bending moments that may be applied to the corresponding work roll 42 in the plane of the work roll axes.

The work roller 42 and the intermediate rollers 44, 46 are each rotatably mounted in the lower carriage 28.

Those rotatable mountings may be journal bearings or any other suitable conventional bearing.

Each of the intermediate rolls 44, 46 is in rolling contact with and is supported by a pair of drive rollers 48, 50, 52. The central drive roller 50 acts as a support for both intermediate rolls. These drive rollers are mounted in the lower carriage 28 by suitable bearings so as to be rotatable with respect thereto. Moreover, it can be seen that the axial length of the cylindrical surfaces on each of the drive rollers 48, 50 52 is essentially coextensive with the cylindrical surfaces of the intermediate rolls 44, 46. And, the diameter of each of the drive rolls 48, 50, 52 is larger than the diameter of the intermediate rolls 44, 46.

The progression in diameter of the rolls from the work roll 42 to the intermediate rolls 44, 46 to the drive rolls 48, 50, 52 creates a structure which is very stiff against bending moments in the plane of the work roller axes. Moreover, since the increasing diameter of successive levels of rolls causes the structure to span a substantial included angle about the axis of the work roll 42, the roller assembly also provides a significant resistance to bending moments in the direction normal to the plane containing the work roll axes while also constraining the work rollers to retain their centered orientation during the actual cold rolling operation. With the preferred diameter relationships between the intermediate rolls 44, 46 and the work roll 42, bending moments in planes at angles of 125° to the plane of the work rolls 20, 40, 42 are reacted.

In order to allow the work roll 42 and the intermediate rolls 44, 46 some degree of self-adjustment with respect to the lower housing 28, each of those rolls 42, 44, 46 may be provided with a corresponding stub shaft projecting axially from each end thereof. The primary purpose of the stub shafts is to center the work rolls and keep them centered but can also assist in retention of the rolls in their proper relative positions when the upper and lower carriages 24 and 28 are not pressed together. By capturing each of these stub shafts in corresponding grooves of the lower carriage 28, the desired adjustability is obtained while still ensuring that the rollers will be contained by and moved along with the lower carriage 29.

Figure 2:
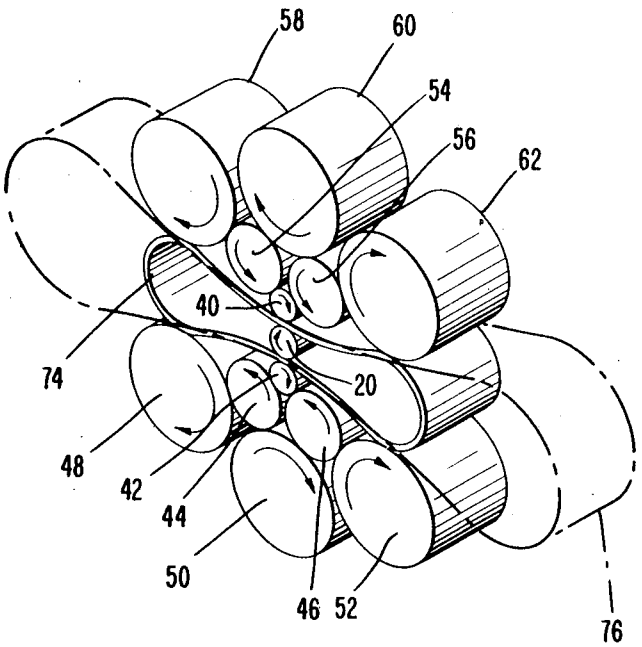
FIG. 2 is a pictorial schematic view of the apparatus of the present invention while the endless metal band is being cold-rolled with portions removed in the interest of clarity.

The upper carriage 24 (see FIG. 2) also includes a pair of intermediate rolls 54, 54 which are identical in all respects to the intermediate rolls 44, 46 described in connection with the lower carriage 28. In addition, the upper carriage 24 includes three drive rollers 58, 68, 62 which are identical in all respects to the drive rollers 48, 50, 52 of the lower carriage 28.

The upper and lower carriages 24, 28 may be mounted for vertical movement with respect to a supporting frame 90 (see FIG. 5). In order to move the carriages 24, 28 simultaneously in opposite directions, the controlling devices 26, 30 may be interrelated. More particularly, the controlling device 26 for the upper carraige 24 may include threaded lugs 92, 94 attached at each corner of the upper carriage 24 and cooperating with a correspondingly threaded portion 96, 98 of corresponding shafts. Similarly, the lower carriage 28 may include threaded lugs 100, 102 attached at each corner and cooperating with correspondingly threaded portions 104, 106 of corresponding shafts. These threaded portions are interrelated quite simply by making the upper threads 96, 98 right handed, the lower threads 104, 106 left handed and putting the oppositely threaded portions on ends of a common shaft 108, 110. It will be understood that four shafts are used, only two of which are visible in FIG. 5; the two remaining shafts being identical to the shafts 108, 110 and being symmetrically located on the carriages 24, 28 such that all four shafts are symmetrically positioned relative to the cold rolling center axis 22.

Each end of each shaft 108, 110 is rotatably mounted in the frame 90 with suitable bearings. In addition each shaft 108, 110 carries a corresponding sprocket 112, 114 with all four sprockets 112, 114 being connected by, for example, a roller chain 116 to a single drive sprocket 118. Preferably the drive sprocket 118 is driven by a reversible triple worm, speedcontrolled, electric motor 120 that is mounted to the frame 90.

In order to power the cold rolling operation, the frame 90 has triple worm reducer, variable speed, electric motor 122 mounted thereon. The output gear 124 of this main drive motor 122 meshes with each of two drive gears 124, 126, which serve the upper carriage 24 and the lower carriage 28, respectively. Suitable bearing supports and bearings rotatably mount the drive gears 124, 126 to the frame in fixed spatial relationship to one another.

Each drive gear 124, 126 is connected to a corresponding bull gear 128, 130 carried on a corresponding one of the carriages 24, 28 by a corresponding rotary coupling 132, 134. Each coupling 132, 134 includes an intermediate shaft 136 which has straight, running-fit splines which cooperate with a coupling 138 to permit axial adjustment of the coupling length. Moreover, the intermediate shaft 136 is connected by a universal joint 142 to the associated bull gear while the coupling 138 is connected by a universal joint 140 to the associated drive gear 124. In this fashion, the carriages 24, 28 can move relative to the frame 90 while rotary power is continuously provided to the bull gears 128, 130.

Figure 6:
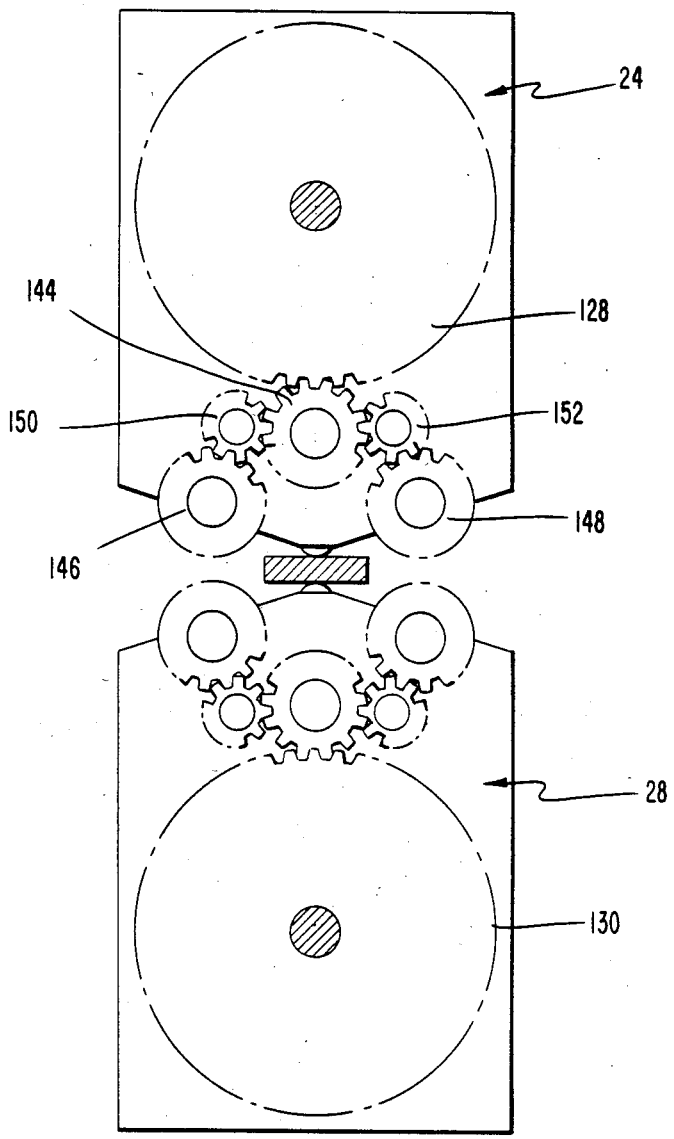
FIG. 6 is an enlarged partial cross-sectional view taken along the line 6—6 of FIG. 5.

The bull gear 128 is rotatably mounted on the upper carriage 24 by suitable bearings and is in meshed relationship with a pinion 144 carried by the central drive roller 60 (FIG. 6). In order to simultaneously drive the pinions 146, 148 of the other two drive rollers, one idling gear 150 is disposed between the pinions 144, 146, and a second idling gear 152 is symmetrically between disposed pinions 144, 148.

Preferably all gears used in the drive system have helical gear teeth.

A collection device 150 (FIG. 5) is aligned with the central work roller 20 and attached to the frame 90. The collection device 150 is adapted to receive and accumulate individual endless metal bands when fabrication is completed. Moreover, the collection device 150 surrounds and cooperates with the strut 152 supporting the central work roll 20 and includes a curved shroud 154 as well as a cam plate 158.

The curved shroud 154 extends from the central roller 20 to a collector ring 156. In addition the shroud 154 has an arcuate surface with the radius decreasing from a maximum value adjacent the work roll 20 to a minimum value adjacent the collector ring 156. That minimum value is less than the radius of the collector ring 156 so that the band can be inserted therein.

Figure 7:
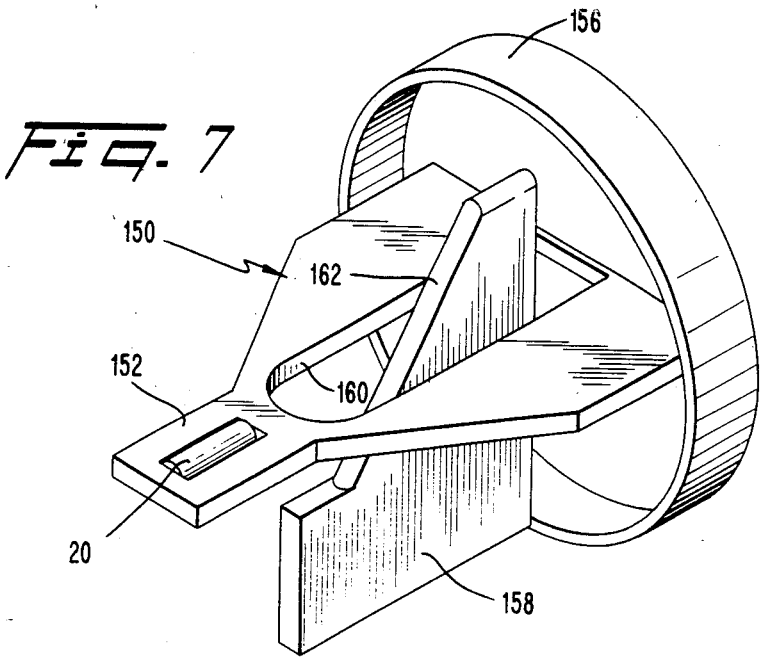
FIG. 7 is an enlarged pictorial view of the band collecting device.

The support strut 152 (FIG. 7) has a longitudinally extending slot 160 through which a portion of the cam plate 158 projects. The upper edge 162 of the cam plate 158 is suitably contoured to avoid damage to an endless metal band as it is pushed toward the collector ring 156.

OPERATION

The first step in fabricating an endless band in accordance with the present invention is to provide a suitable generally circularly cylindrical preform or blank. A suitable preform must be free of welded joints and other discontinuities. In addition, the preform must have an axial length which is essentially the desired axial length for the finished band and a diameter at least about twice the diameter of the central work roll 20. The preform may be fashioned from any desired material, metal, plastic, etc. For purposes of the following discussion, however, it will be assumed that the preform is fashioned from 17-7 PH, 15-5 PH or Carpenter 455 stainless steel since bands of these materials are desired.

One suitable process for preparing a preform is to part a preform 72 (see FIG. 1) from an annealed seamless tube 70 having a predetermined wall thickness about twice the thickness ultimately desired and made of precipitation hardenable stainless steel. The preform or blank 72 can be parted from the tube 70 by cutting the preform 72 from the tube 70 with a parting tool in the lathe-type turning operation, using a slitting saw, using an abrasive disk, or by using roll shearing. It is also possible to prepare a preform 72 by machining either plate or thick-wall tubing to obtain a preform.

Once the preform 72 has been obtained, the preform is elastically distorted to prepare it for loading into the operating zone 38 of the cold working mill apparatus. This elastic distortion can be accomplished by hand. If desired, however, the distortion could be obtained by pushing the preform 72 through a boot in which the elastic distortion progressively increases while the preform 72 passes through the boot in a direction parallel to the axis of the preform 72.

With the preform 72 elastically distorted in preparation for the cold-rolling process, the distorted preform 74 is positioned in the working zone 38 and around the central work roller 20. The distorted preform 74 (see FIG. 2) is given further elastic distortion by the movement of the upper carriage 24 toward the central work roller 20 and by movement of the lower carriage 28 toward the central work roller 20. The upper carriage 24 is moved toward the central work roller 20 until the upper work roller 40 engages the top surface of the preform 74. Similarly, the lower carriage 28 moves until the work roller 42 engages the outside surface at the bottom of the distorted preform 74. Continued movement of the upper and lower carriages moves the upper work roller 40 and the lower work roller 42 toward one another and toward the central work roller 20 until the preform 74 is disposed in the nip between the upper work roller 48 and the central work roller 20 and also disposed in the nip between the lower work roller 42 and the central work roller 20.

The controlled application of compressive forces through the control means to the upper carriage means and the lower carriage means through rotation of the shafts 108, 110 (FIG. 5) causes the nips between the parallel work rollers 24, 40, 42 (FIG. 1) to be decreased in size. Now, the upper drive rollers 58, 60, 62 and the lower drive rollers 48, 50, 52 begin rotating in the same direction (see FIG. 2). As shown, the drive rollers are given an initial clockwise rotation.

By virtue of the frictional contact between the cylindrical surfaces of the drive rollers and the associated intermediate rollers 54, 56, 44, 46 and by virtue of the pressure exerted by the control means of the respective carriages, the drive rollers 56, 60, 62, 48, 58, 52 cause an oppositely directed rotation to be imparted to the intermediate rollers.

Now, by virtue of the rolling contact and the friction and the pressure exerted by the upper carriage 24 on the upper work roller 40 and the lower carriage 28 on the lower work roller 42, the intermediate rollers 44, 46, 54, 56 cause an opposite rotation in the upper and lower work rollers 40, 42. The direction of rotation of these work rollers 40, 42 corresponds in a sense to the direction of rotation of the drive rollers. Since the central work roller 20 is confined from movement out of the plane of the axes of the rollers 40, 42 and since the central roller is rotatably mounted, the central roller rotates in the direction opposite to that of the first and second work rollers 40, 42 which are disposed above and below it respectively.

The opposed rotation of the pairs of work rollers 40, 20 and 20, 42 moves the distorted preform 74 in the direction of its peripheral outline. Moreover, because of the pressure exerted between the pairs of work rolls 40, 20 and 20, 42 the peripheral length of the distorted preform 74 is caused to increase or blossom. This elongation is the result of the cold working effected by the pressure acting on the metal between the nips of the work rollers 20, 40, 42. The drive rollers 48, 59, 52, 58, 60, 62 continue their driving rotation until the distorted preform 74 has blossomed to its final configuration 76. In the final configuration 76 the wall thickness of the preform 74 has been reduced to a predetermined final value and the peripheral length of the preform 74 has been increased to approximately twice its original length. Accordingly, the preform is given approximately a 50% cold working. Preferably, the final thickness value is in the neighborhood of 0.005 inches. The symmetrical application of cold-working pressure to the work rolls 40,42 and the central work roll 20 in conjunction with the identity of size, shape, material and surface finish cooperate to symmetrically cold work each side of the endless band as the band moves through the two nips between the work rolls 20, 40, 42.

Figure 3:
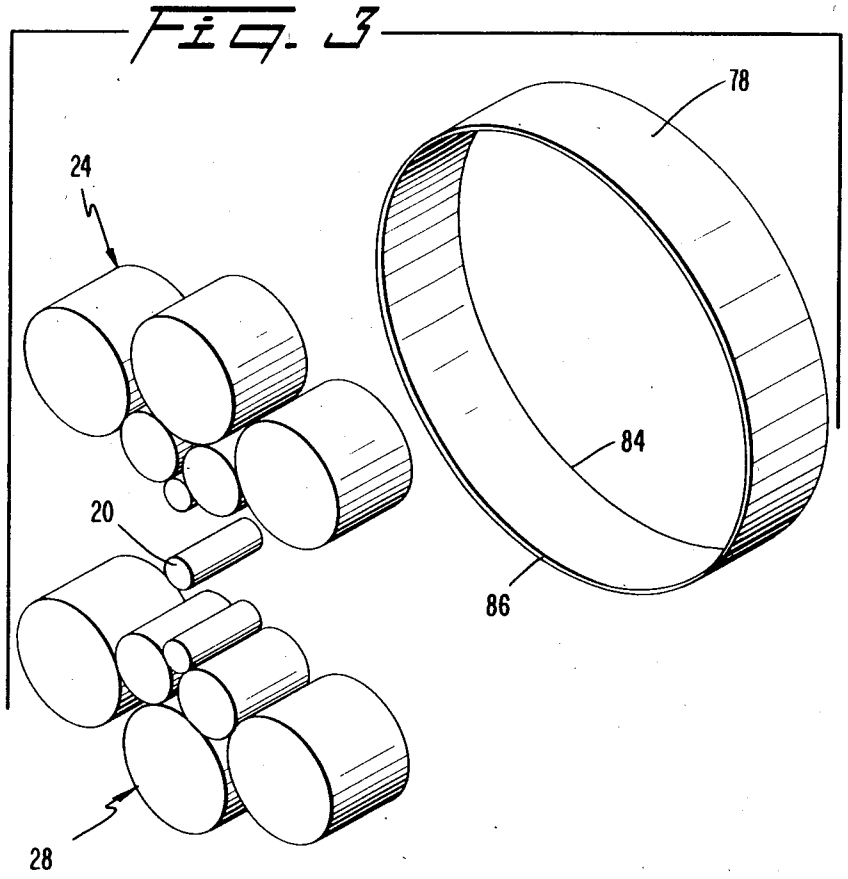
FIG. 3 is a pictorial schematic view of the apparatus of the present invention at the end of the production method with portions removed in the interest of clarity.

While the cold working operation occurs, the length and thickness of the preform 74 are continuously monitored. The monitoring may be accomplished by the beta gauges, by work riding micrometers, or by optical limit switches. As the preform 74 mushrooms to its final configuration 76 and thickness, the pressures exerted by the control means in the upper carriage and the lower carriage are reduced. In this fashion, the final thickness is obtained by small incremental changes. Moreover, the cold working is effected in two incremental steps during each pass of the preform through the rolling mill. Furthermore, as will be seen from FIG. 3, the finished band has an axial length which is small in relation to the circumferential length of the band.

After the final rolled length of the endless metal band has been obtained, the upper carriage 24 (see FIG. 3) is moved upwardly and away from engagement with the central work roller 20 and lower carriage 28 is moved downwardly and away from central roller 20. At this point, the final endless band 78 (see FIG. 3) can be removed from the rolling mill. It is preferred that the preform is inserted into the rolling mill in the direction of the axis of the central roller 20. Moreover, it is desired and preferred that the finished endless metal band 78 be removed in the same direction along the axis of the central work roll 20. As the finished metal band 78 is removed from the rolling mill, the elastic distortion is released and the band assumes the essentially circularly cylindrical shape depicted.

Figure 8:
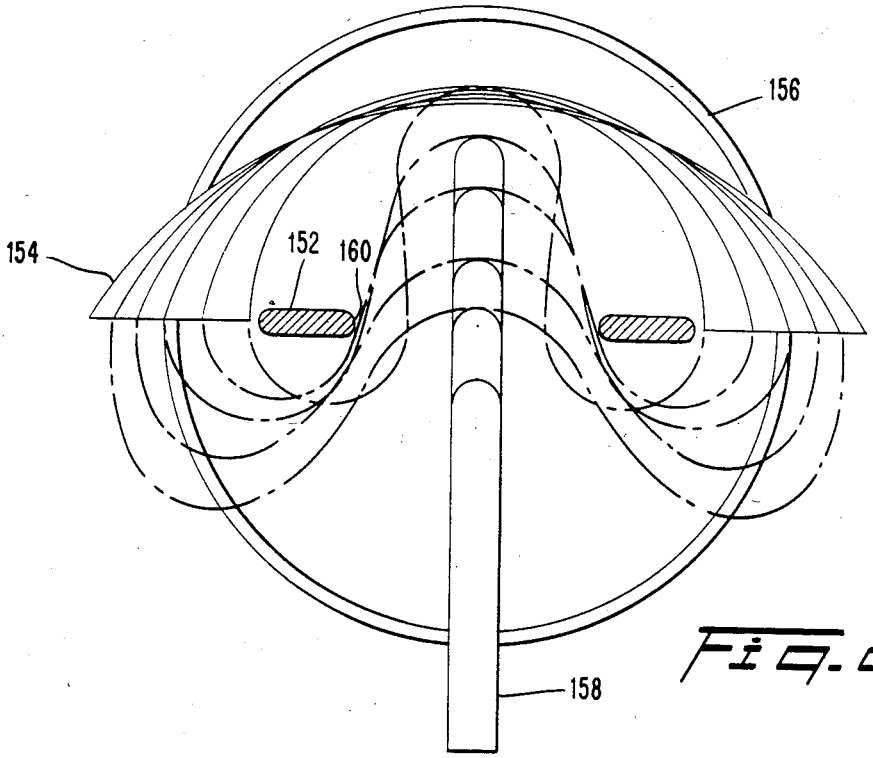
FIG. 8 is a schematic view showing sequential operation of the band collecting device.

Instead of releasing the band the finished band 78 now can be pushed through the collection device 150 (FIG. 5). In the collection device, the decreasing radius of the covering shroud 154 (FIG. 8) causes the upper portion of the band to conform. Simultaneously, the cam plate cooperates with the slot 160 of the support 152 to push the lower portion of the band upwardly so as to attain a saddlebag shape. When the band is released into the collection ring 156 (i.e. when the band leaves the shroud 154 and the cam plate 158), the band expands to the collection ring 156 or to the inside surface of a previously discharged band. When the collection ring 156 is filled, it is removed and emptied or removed and replaced.

During the cold working rolling operation (see FIG. 4) the endless metal band 78 has an inner cylindrical surface 80, an outer cylindrical surface 82, and an edge surface 84. The inner cylindrical surface 80 is in engagement with the central work roller during the cold working operation whereas the outer cylindrical surface 82 is in direct contact with one or the other of the upper and lower work rollers 42, 44. By virtue of the contact between these surfaces 80, 82 and the associated work rollers 20, 40, 42 the surfaces 80, 92 are frictionally locked from relative movement with respect to the surface. However, the edge surface 84 is not subjected to any such constraint. Thus, as the cold working causes an elongation of the metal band 78 in the direction normal to the plane of FIG. 4, some pressure is exerted against the edge surface 84 causing it to become slightly curved, as illustrated (in exaggerated form).

The endless band resulting from this process and apparatus can experience a cold worked thickness reduction of any desired amount. Preferably, as described, the thickness reduction is about 50%. Moreover, the endless band has essentially uniform thickness not only along its axial length but also along its peripheral length. And, the band is free of discontinuities caused by welds and the like. The parallel edges 84, 86 (FIG. 3) of the band are contoured and are free of stress concentration effects such as cusps or sharp corners.

Where the band is made from precipitation hardenable stainless steel, the previously described properties exist. Moreover, when the stainless steel band is then precipitation hardened it experiences the enhanced durability described above.

Stainless steel bands made in accordance with this invention have many uses. The bands may be used in unique speed changing devices where their uniformity, strength, and long fatigue life are desirable. Moreover, the metal bands may be used as replacements for conventional V-belts in all kinds of rotating machinery.

While the lower work roller 42 is illustrated and described in the foregoing as having a diameter the same as the diameter of the work roll 40, it may be desirable to fabricate the lower work roll 42 with a diameter that is larger than the diameter of the upper work roll 40. Such a variation could be desirable for example in light of the fact that cold working of any material does not commence until the applied forces exceed the yield stress of the material being cold worked. When the yield stress has been exceeded in any given material, there is always a residual imperfection retained unless a perfectly smooth and uniform starting shape is employed. The greater the amount of cold working applied to a piece in a single pass, the smaller the residual elastic reflections will be. By using a large roller on the bottom and a small roller on the top the majority of the cold working would be effected by the top and middle work rollers while the bottom and central work rollers would cooperate to produce an effect that would be largely elastic. As a result, improved uniformity may be obtained in the thickness of the endless metal band. Another mechanism to obtain the result described in the preceding paragraph is to use materials having different moduli of elasticity for some of the work rollers.

In some applications it may be desired to provide a particular surface finish or texture to the endless metal band. It is within the teachings of this invention to provide a patterned or textured surface on one or more of the work rolls 20, 40, 42 in order to obtain such a textured or finished surface.

It will now be apparent to those skilled in the art that there has been provided in accordance with this invention a new and unobvious apparatus for fabricating endless metal bands, a process for preparing endless metal bands that do not exhibit any discontinuities, and an endless metal band having properties not heretofore available. Moreover, it will be apparent to those skilled in the art that numerous modifications, variations, substitutions and equivalences exist for various features of the band, the apparatus and the process which do not depart materially from the spirit and scope of the invention. Accordingly, it is expressly intended that all such modifications, variations, substitutions and equivalences which fall within the spirit and scope of this invention as defined in the appended claims be specifically embraced hereby.

What is claimed is:

1. An endless band made according to the method of preparing a circular preform from a seamless tubular member having a predetermined wall thickness; and symmetrically cold rolling both sides of the circular preform between opposing rollers to reduce the predetermined wall thickness to a uniform final wall thickness while circumferentially elongating the preform.

2. An endless band comprising:

a cylindrical band fabricated from metal, having substantially uniform thickness, substantially uniform width, an axial length that is small in relation to the circumferential length, being free of joints, and being symmetrically cold worked.

3. The endless band of claim 2 fashioned from precipitation hardenable stainless steel.

* * * * *